US008690524B2

(12) United States Patent
Yin et al.

(10) Patent No.: US 8,690,524 B2
(45) Date of Patent: Apr. 8, 2014

(54) LOW-NOISE PORTED-SHROUD COMPRESSOR FOR A TURBOCHARGER

(75) Inventors: Junfei Yin, Bedford (GB); Romil Tanna, Torrance, CA (US); Stephane Pees, Ceintrey (FR)

(73) Assignee: Honeywell International Inc., Morristown, NJ (US)

( * ) Notice: Subject to any disclaimer, the term of this patent is extended or adjusted under 35 U.S.C. 154(b) by 608 days.

(21) Appl. No.: 12/899,023

(22) Filed: Oct. 6, 2010

(65) Prior Publication Data

US 2011/0085902 A1 Apr. 14, 2011

Related U.S. Application Data

(60) Provisional application No. 61/249,861, filed on Oct. 8, 2009.

(51) Int. Cl.
*F04D 29/66* (2006.01)

(52) U.S. Cl.
USPC ..... 415/119; 415/144

(58) Field of Classification Search
USPC ..... 415/57.1, 57.2, 57.3, 57.4, 58.1, 58.2, 415/58.3, 58.4, 119, 144, 145, 914
See application file for complete search history.

(56) References Cited

U.S. PATENT DOCUMENTS 5,246,335 A * 9/1993 Mitsubori et al. ..... 415/58.3
5,295,785 A 3/1994 Church et al.
5,399,064 A * 3/1995 Church et al. ..... 415/58.3
5,863,178 A * 1/1999 Scheinert et al. ..... 415/58.4
2008/0134678 A1 6/2008 Noelle et al.
2008/0247870 A1* 10/2008 Sirakov et al. ..... 415/226

FOREIGN PATENT DOCUMENTS

EP 1 985 865 A2 10/2008

OTHER PUBLICATIONS

Partial International Search Report for PCT/U52010/051796 dated Mar. 1, 2011.

* cited by examiner

*Primary Examiner* — Edward Look
*Assistant Examiner* — Juan G Flores
(74) *Attorney, Agent, or Firm* — Alston & Bird LLP

(57) ABSTRACT

Various embodiments of ported-shroud centrifugal compressors are described. In some embodiments a wall of a compressor housing defines a pair of bulb-shaped hollow spaces or "bulbs", one located proximate the compressor wheel and the other spaced upstream from the wheel, and having a connection therebetween. The downstream bulb is connected to the main flow path of the compressor by a port slot through the wall. The upstream bulb is connected to the inlet area of the main flow path by a passage through the wall. The bulbs can provide acoustic wave cancellation through multiple internal reflections in various directions. In one embodiment, the upstream bulb has a second passage connected to it, facing axially upstream, for receiving a portion of the total flow in a choked-flow operating regime, and conducting that portion through the upstream bulb, through the connection to the downstream bulb, and through the port slot into the main flow path.

11 Claims, 10 Drawing Sheets

LOW-NOISE PORTED-SHROUD COMPRESSOR FOR A TURBOCHARGER

CROSS-REFERENCE TO RELATED APPLICATION

This application claims the benefit of the filing date of U.S. Provisional Patent Application Ser. No. 61/249,861 filed on Oct. 8, 2009, currently pending, the entire disclosure of which is hereby incorporated herein by reference.

BACKGROUND OF THE INVENTION

Most of today's diesel engines are turbocharged, and more and more gasoline engines are being turbocharged. The benefits of turbocharging (reduced engine size and weight, improved fuel economy, increased power density, and reduced emissions) are well known. Tightening emission standards, high fuel-economy requirements, and end user demand for drivability require modern turbocharged gasoline and diesel engines to operate over a wider flow range, or in other words, to have a wider compressor map. There is ever-increasing demand for low-end torque and high power requirements, and thus need for compressor stages having greater map-width at high pressure ratio (3.0 and above).

Compressor stages in which wheels operate in a regular housing exhibit limitations in either stability at high pressure ratio or maximum flow capacity. Ported-shroud compressor housings are known to improve map width at high pressure ratios, but typically they bring a penalty of increased blade pass source acoustics level. Often the increased source acoustics level makes engine/vehicle system blade pass noise level unacceptable in production passenger vehicles. The increase in the source acoustic level can be as high as 15 dB as compared to a regular compressor housing. With such increased source noise and ever-diminishing engine noise, the gap between the turbocharger-related tonal noise and engine/vehicle system background noise widens even more and makes the turbocharger-related noise level unacceptable in production passenger cars.

SUMMARY OF THE DISCLOSURE

The present disclosure describes the results of a development effort aimed at controlling the blade pass noise level of a turbocharger having a ported-shroud compressor. The goal was to reduce the compressor blade pass source acoustic level while maintaining aerodynamic performance of the compressor. Several different configurations of ported-shroud compressors were designed and tested in order to achieve the reduction in compressor blade pass source acoustic level.

In a first embodiment described herein, a compressor comprises a compressor wheel and a compressor housing surrounding the compressor wheel and defining an inlet for leading fluid along a main flow path into the compressor wheel and through the compressor wheel to be compressed thereby. The compressor housing has a wall surrounding the main flow path and defining a port slot located adjacent the compressor wheel. The wall further defines first and second bulbs comprising bulb-shaped, generally annular hollow spaces. The first bulb is located proximate the port slot and is connected to the port slot, and the second bulb is located proximate the inlet to the compressor, upstream of the first bulb. The compressor housing further defines a connection between the first and second bulbs that allows flow from one to the other in either direction. The connection can comprise an annular space partitioned by a plurality of circumferentially spaced struts extending radially across the annular space from a radially outer wall portion to a radially inner wall portion of the wall.

The compressor housing additionally defines at least a first passage into the second bulb, the first passage facing generally radially inwardly into the main flow path and allowing fluid to pass between the main flow path and the second bulb in either direction.

The two bulbs may provide acoustic wave cancellation by virtue of acoustic waves being reflected multiple times in different directions from the curved inner surfaces of the bulbs. The series of reflections at different angles may cause phase mismatch and thus cancellation of amplitude. The second (upstream) bulb may also help block acoustic waves from being propagated forward.

In a second embodiment comprising a variation of the first embodiment, the compressor housing defines a second passage that connects with the second bulb, and each of the first and second passages into the second bulb can include a row of vanes (designated the "first vanes" and "second vanes", respectively). The second passage is directed towards the incoming flow and thus in a choked-flow condition some flow can enter the second passage into the second bulb, and then through the connection to the first bulb and out the port slot into the main flow path, in order to increase the choke flow rate. The second vanes in the second passage act like axial-flow inlet guide vanes, guiding the fluid to flow towards the compressor wheel so as to increase the choke flow. There could be a small portion of the total flow going into the first passage at the choked-flow operating condition. Thus, with this arrangement, depending on the operating condition fluid can flow through the first and second passages in either direction (to or from the second bulb), and likewise fluid can flow through the port slot (to or from the first bulb) in either direction.

The first vanes in the first passage are radial vanes for guiding recirculated flow (which flows through the compressor port slot to the first bulb and then through the connection to the second bulb) through the first passage back into the compressor inlet. The vane angle can be positive or negative. The first vanes can be used to reduce the surge flow and to change the angle of incidence at the wheel inducer. The aim is to vary (increase or reduce) the pressure ratio in a surge operating regime.

The compressor housing assembly can comprise a main compressor housing that defines the volute and diffuser, and an inner insert that defines the compressor inlet and also defines the port slot as well as the two bulbs and passages.

In a third embodiment, there are two bulbs similar to the first embodiment. The wall of the compressor housing further defines a plurality of elongate blind holes radiating outwardly through an inner surface of at least one of the first and second bulbs, the blind holes acting as quarter-wavelength resonators. The blind holes are of different lengths and diameters from one another, although for a given length and diameter there can be multiple holes having that length and diameter. Preferably each of the first and second bulbs includes the blind holes. Additionally, the wall can define a generally annular projection at a radially outer side of the first passage, the generally annular projection extending generally radially outwardly into the second bulb. The lengths and diameters of the blind holes are selected based on the quarter-wavelength resonator concept. Different lengths of holes target different frequency bands, thus providing acoustic absorption across a wide frequency range. The target frequency range is from 5-20 kHz.

In a fourth embodiment, there are two bulbs having a connection (e.g., an annular spaced partitioned by struts) therebetween, similar to the first embodiment. In the fourth embodiment, the connection is a single-chamber muffler (expander). The muffler has a main chamber comprising a generally annular hollow space having an axial length L and a radial height T. There is a first inlet/outlet connecting the first bulb to the main chamber, and a second inlet/outlet connecting the second bulb to the main chamber. The first and second inlets/outlets to the main chamber are defined by generally annular openings in first and second ring-shaped members each of which protrudes into the main chamber. The generally annular openings have a radial height t. The distance of protrusion L1 of the first ring-shaped member into the main chamber and the distance of protrusion L2 of the second ring-shaped member into the main chamber are selected based on the frequencies to be attenuated. The ratios L1/L and L2/L and the area ratio dependent on t and T define the transmission loss and frequency range over which attenuation is provided. For a wider frequency range, L1/L can be 0.25 and L2/L can be 0.5.

In a fifth embodiment, a compressor comprises a compressor wheel having full blades that are N in number, and a compressor housing surrounding the compressor wheel and defining an inlet for leading fluid along a main flow path into the compressor wheel and through the compressor wheel to be compressed thereby. The compressor housing includes a first housing portion that defines a volute and a second housing portion that defines an outer ring-shaped member that surrounds and is radially spaced from an inner ring-shaped member such that a generally annular space exists between a radially inward side of the outer ring-shaped member and a radially outer side of the inner ring-shaped member. The second housing portion is arranged such that an axial space exists between a downstream end of the second housing portion and an adjacent portion of the first housing portion so as to form a port slot that connects with a downstream end of the generally annular space. An axial space exists between an upstream end of the inner ring-shaped member and an adjacent part of the outer ring-shaped member, which axial space forms a passage that connects the inlet of the compressor with an upstream end of the annular space. The outer ring-shaped member is connected to the inner ring-shaped member by a plurality of circumferentially spaced struts extending between the radially outer side of the outer ring-shaped member and the radially inward side of the inner ring-shaped member. The struts are from N to 3N+1 in number. Thus, for example, if the compressor wheel has 6 full blades and 6 splitter blades, then there are from 6 to 19 struts. The inclusion of N to 3N+1 struts has acoustic benefits.

The annular space between the ring-shaped members forms a recirculation path or alternate flow path that fluid can pass through in either direction, depending on the particular operating condition of the compressor. The struts can extend axially such that they can either cross the ported slot or stop short of the ported slot.

BRIEF DESCRIPTION OF THE DRAWINGS

Figure 1A:
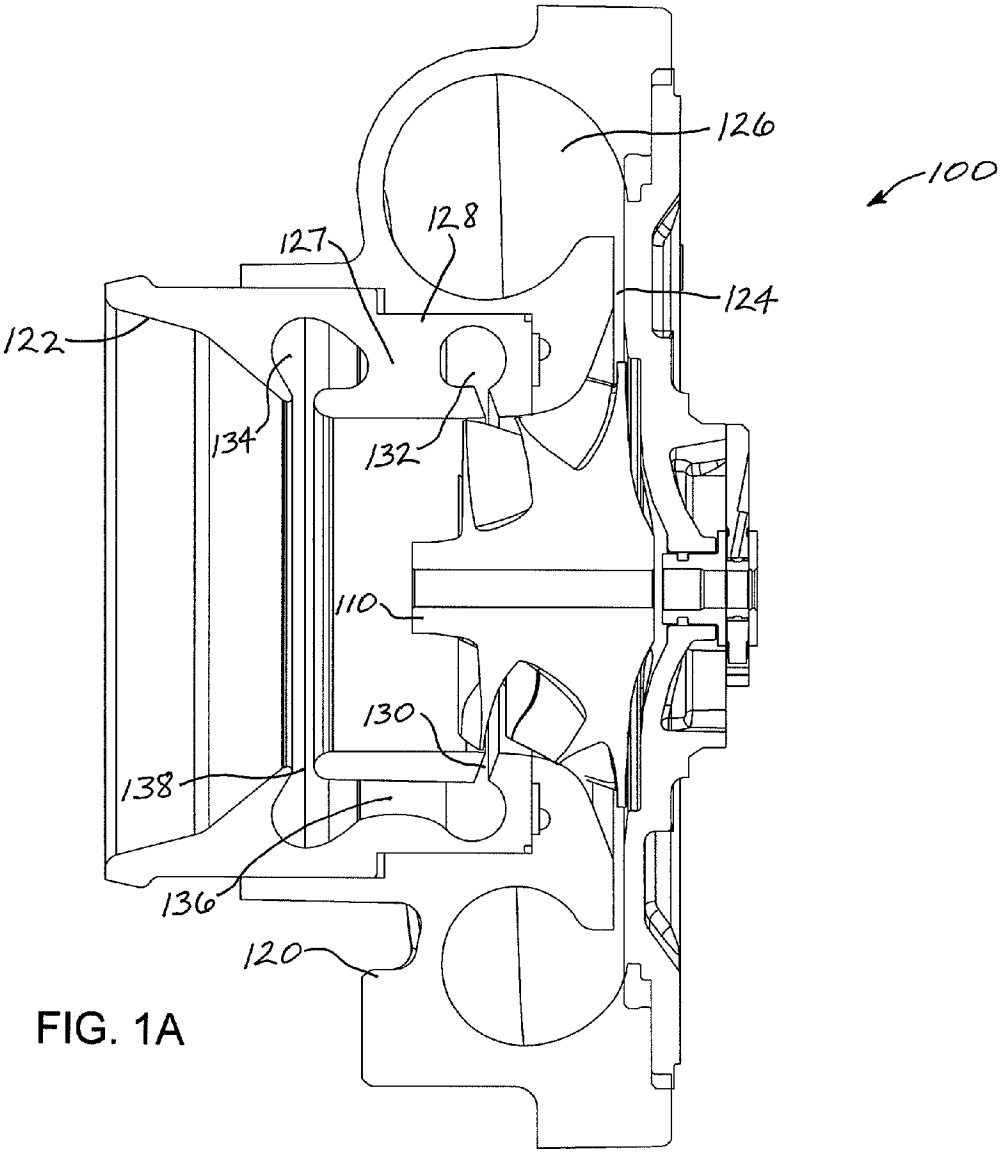
Figure 1B:
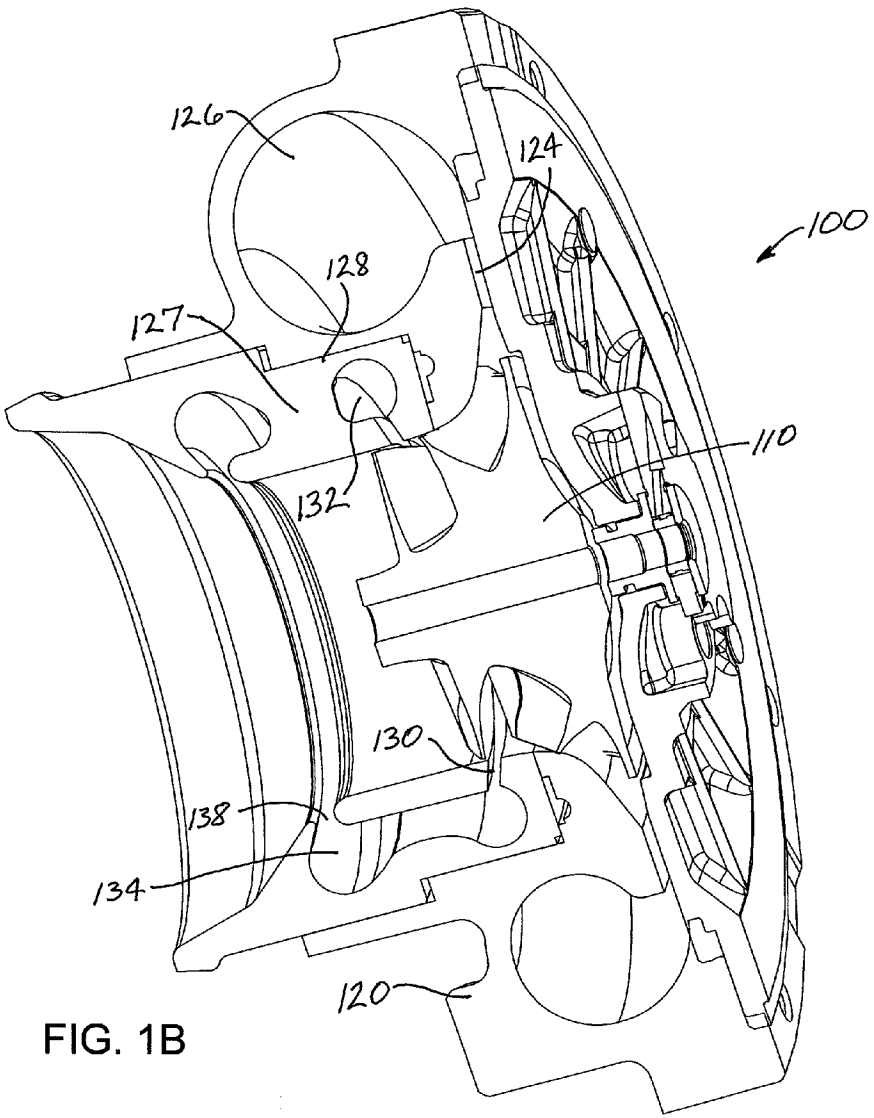
Figure 2A:
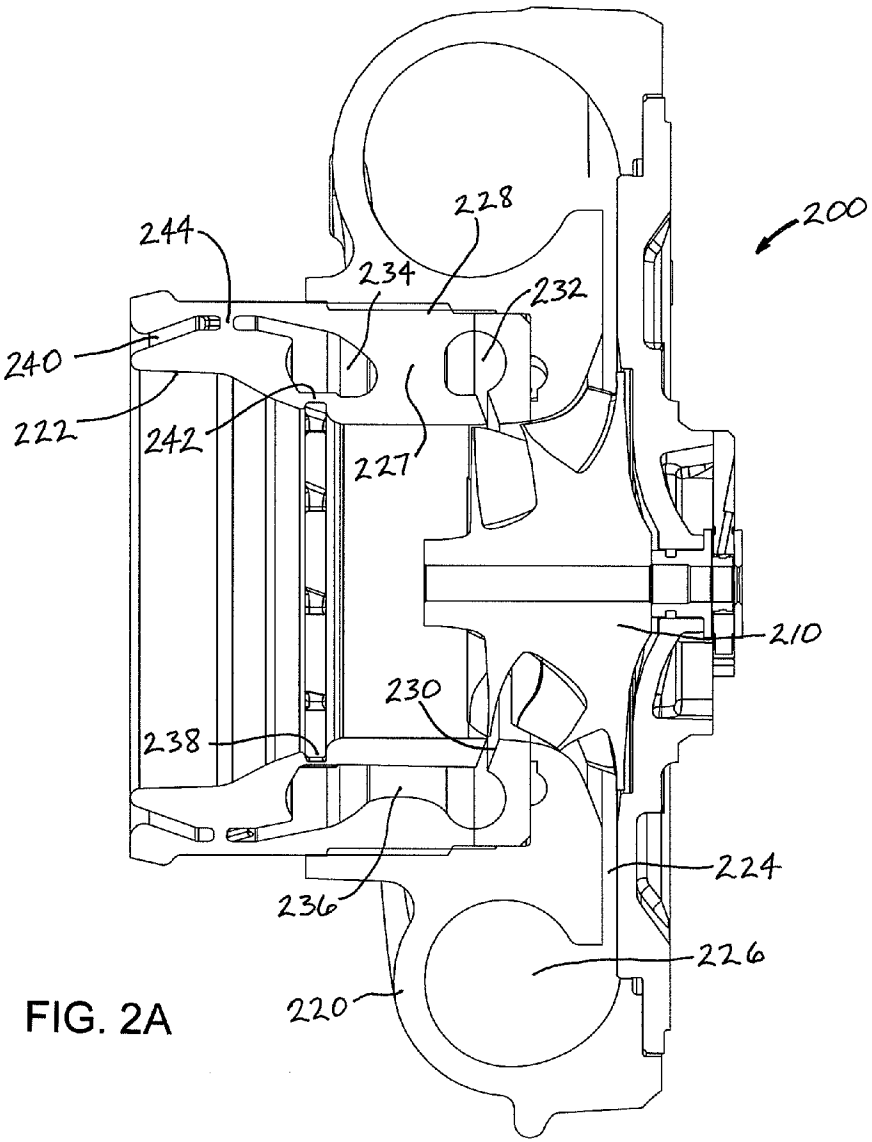
Figure 2B:
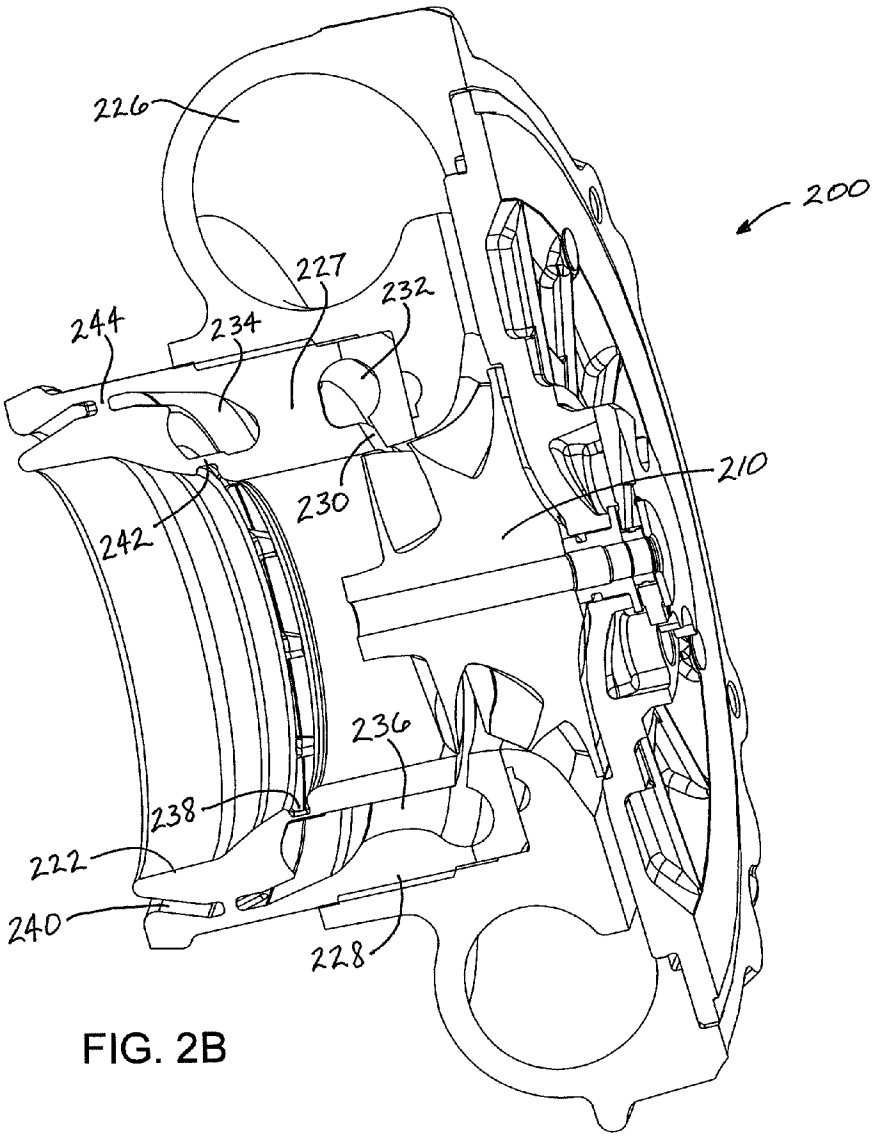
Figure 3A:
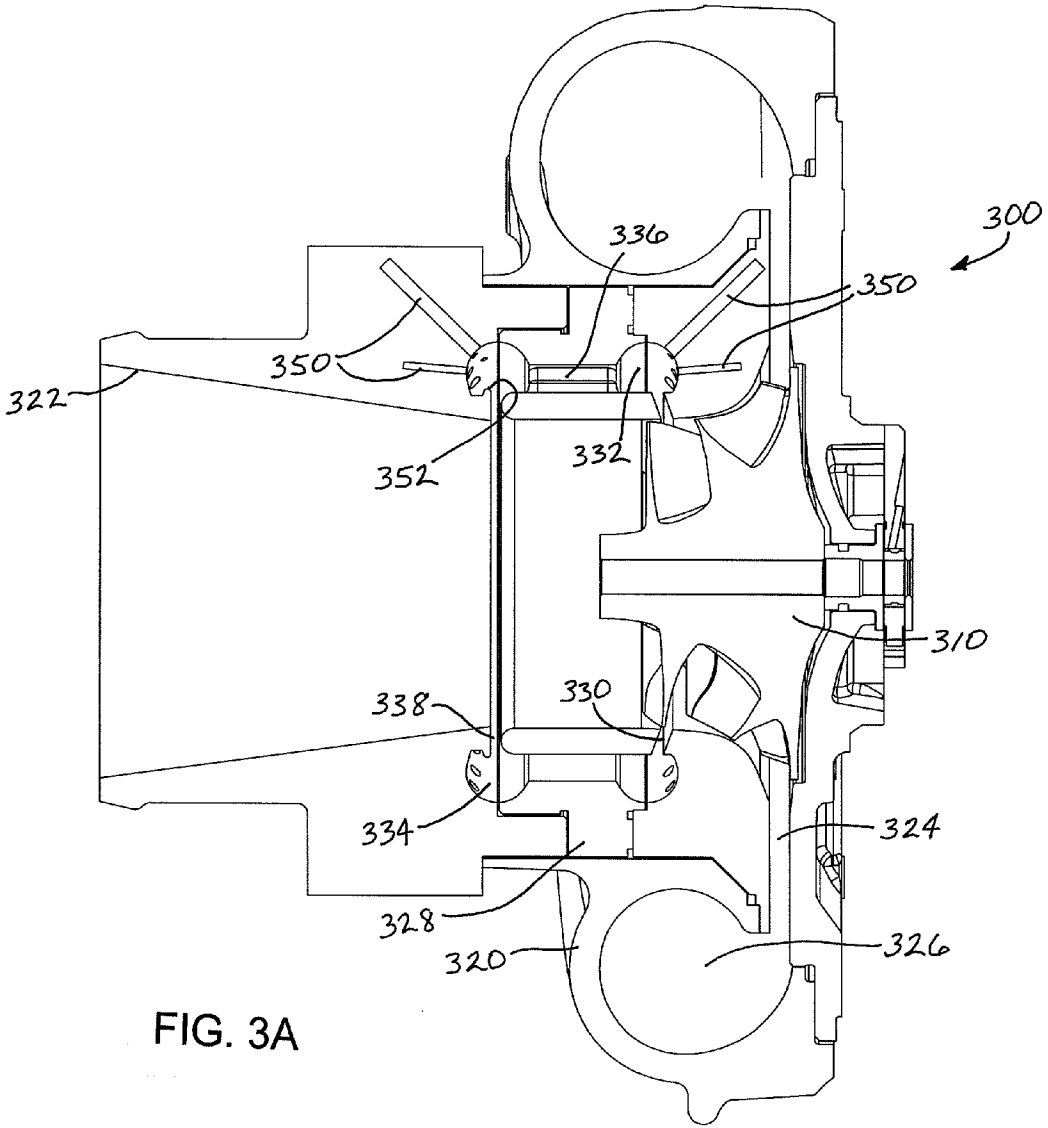
Figure 3B:
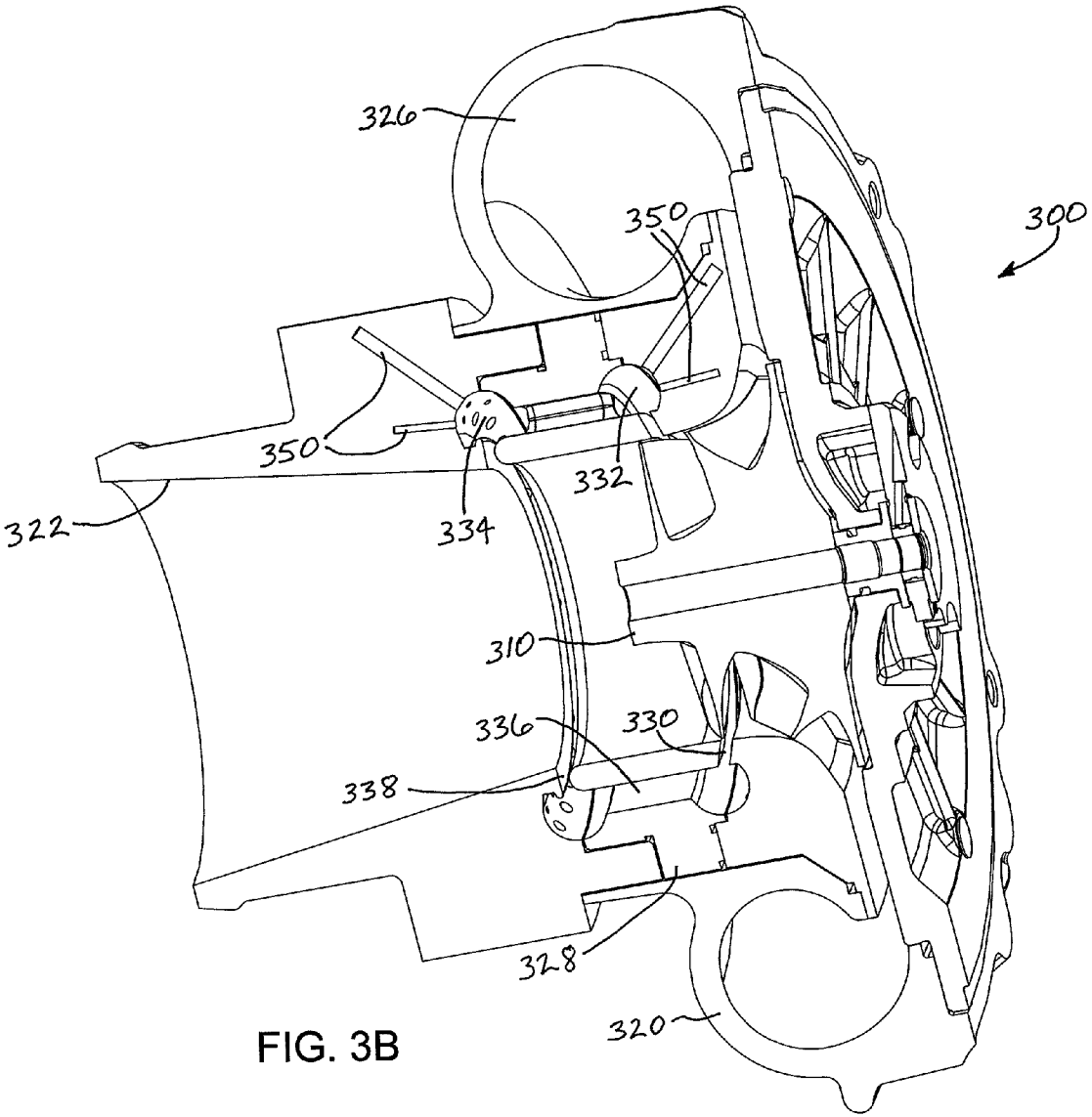
Figure 4A:
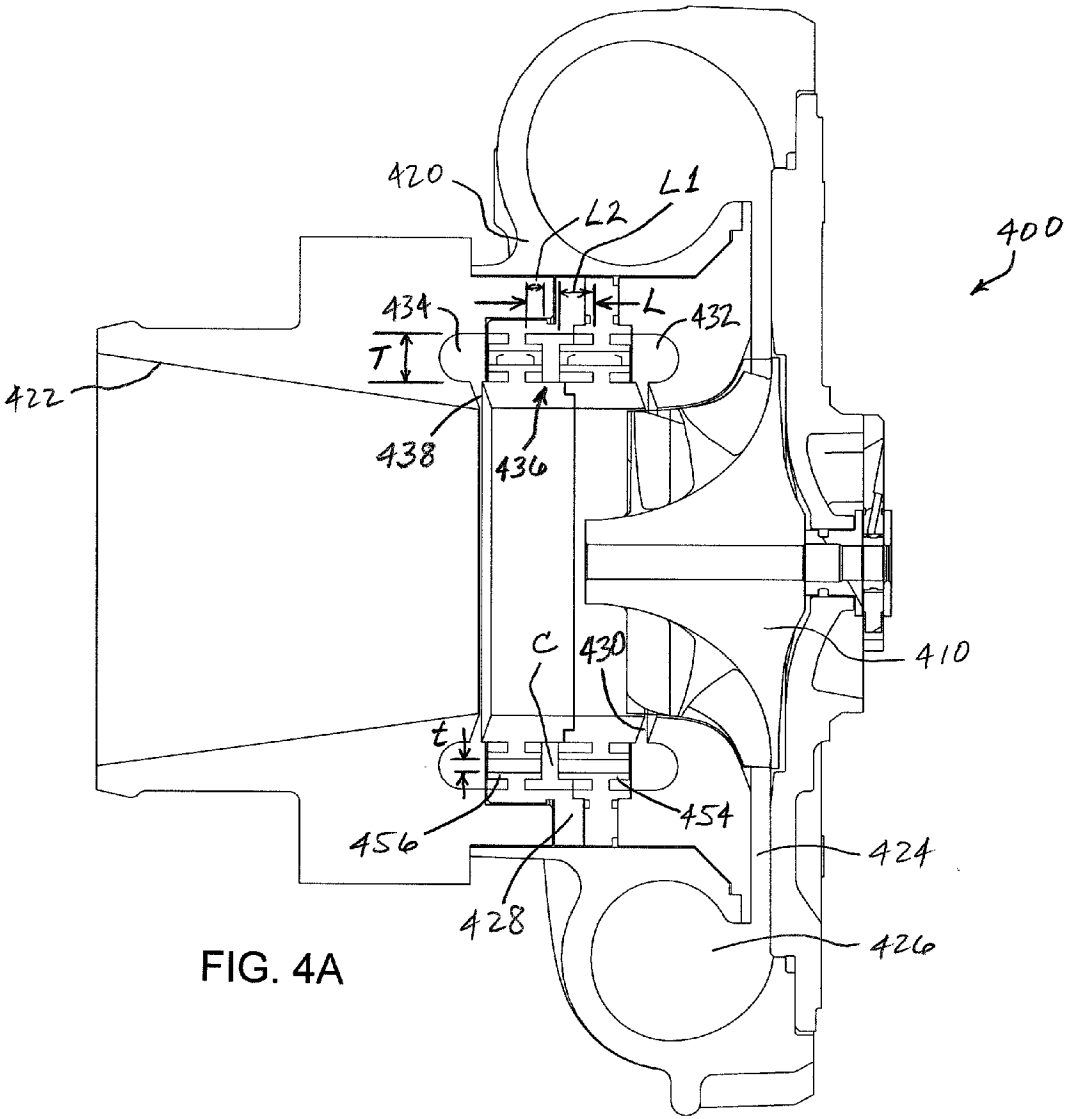
Figure 4B:
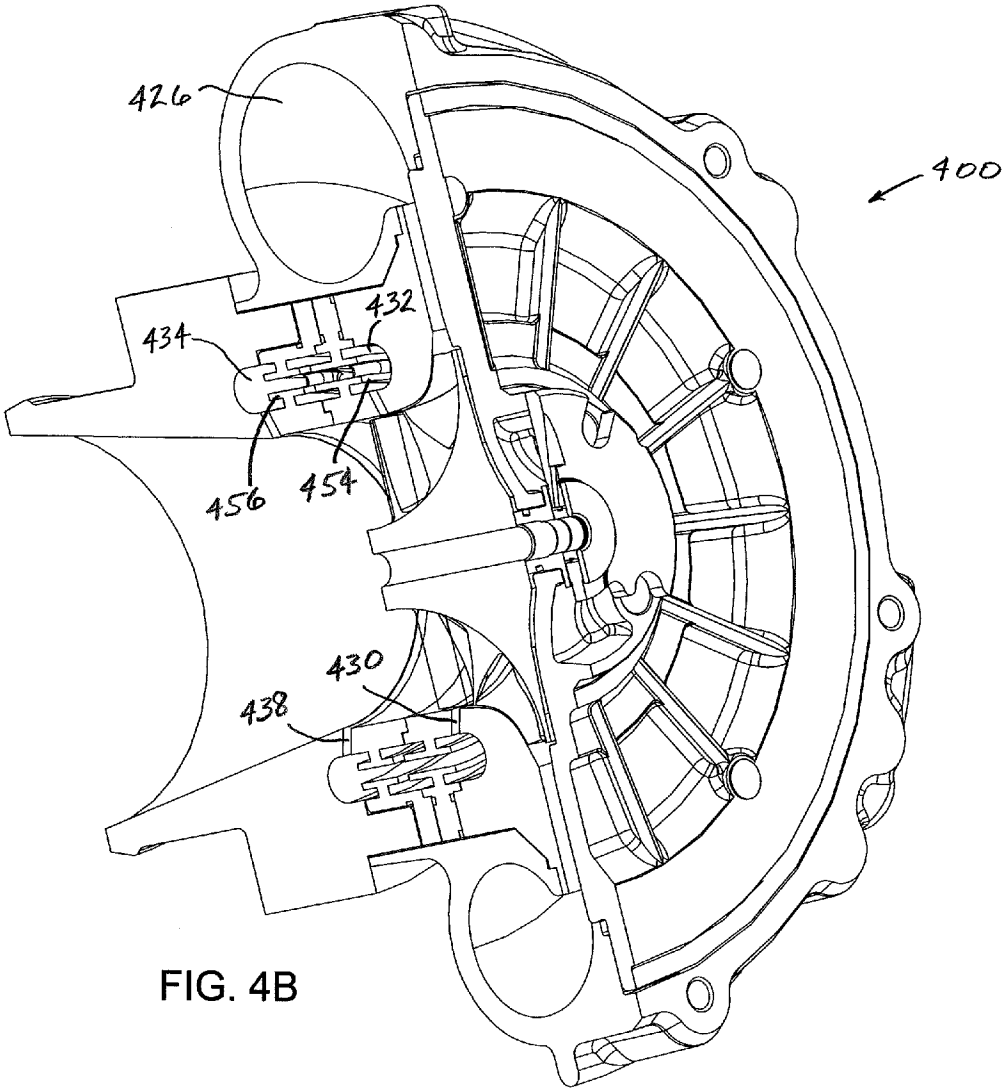
Figure 5A:
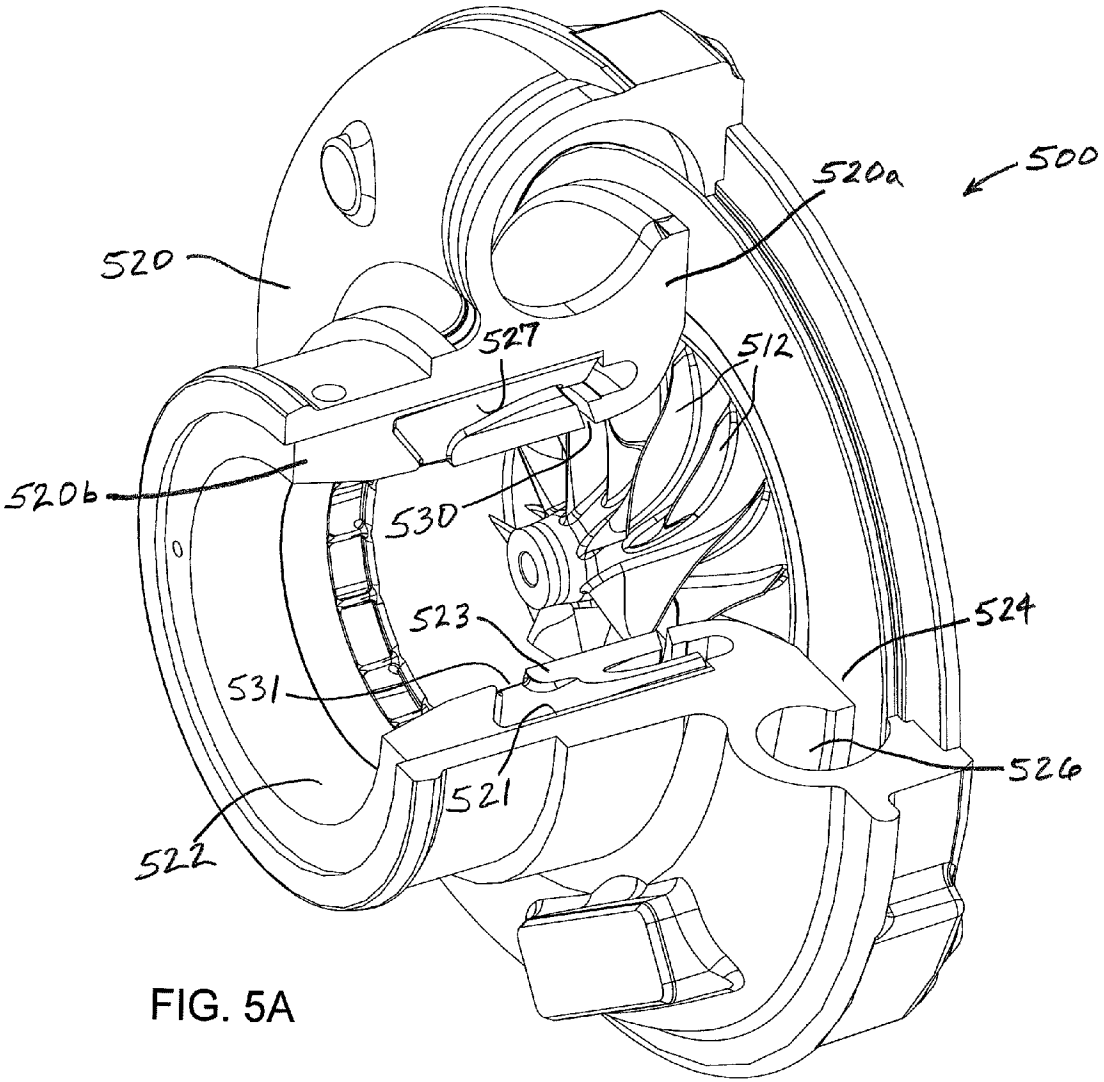
Figure 5B:
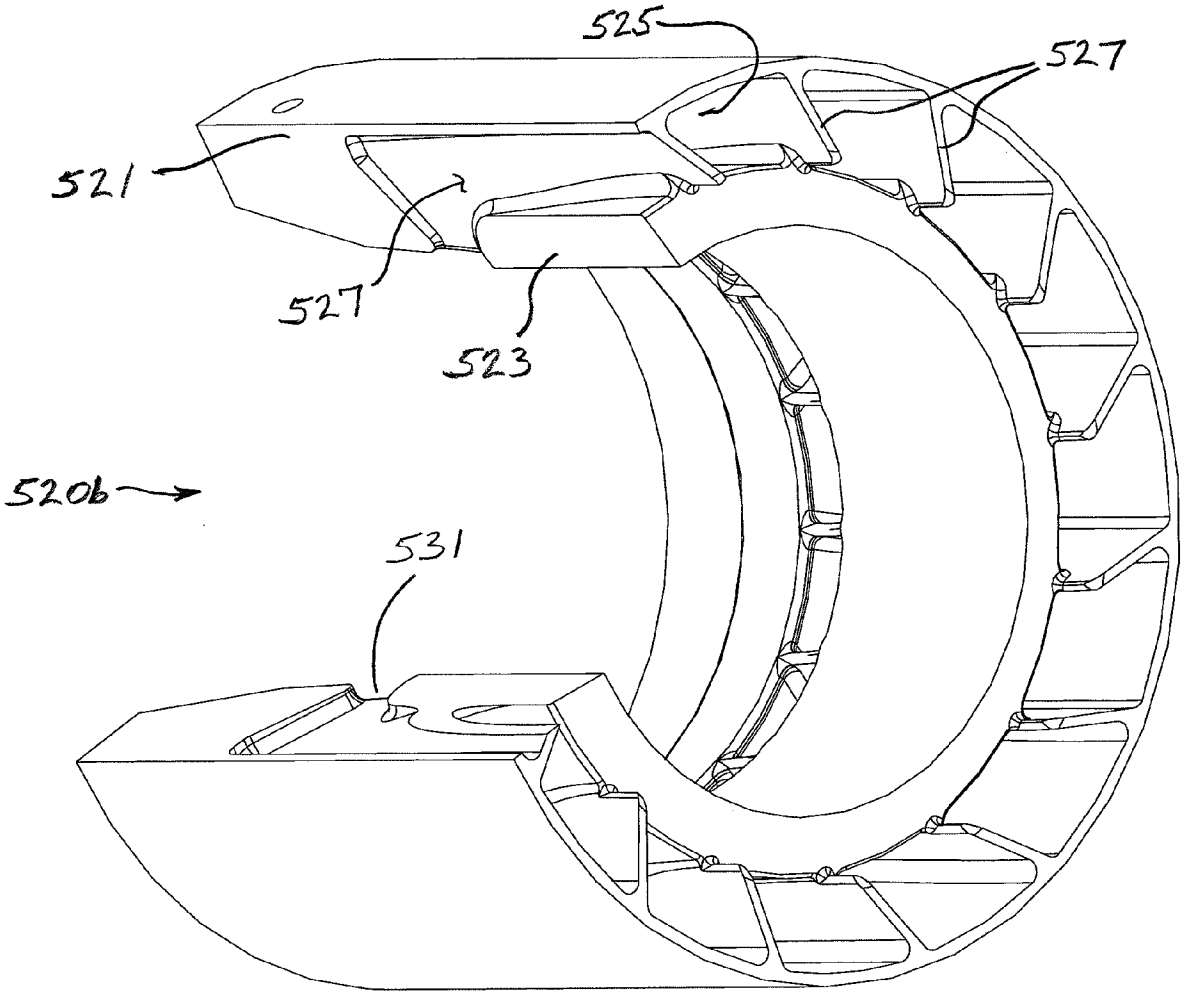

Having thus described the invention in general terms, reference will now be made to the accompanying drawings, which are not necessarily drawn to scale, and wherein:

FIG. 1A is an axially sectioned side view of a compressor in accordance with a first embodiment of the invention;

FIG. 1B is an axially sectioned isometric view of the compressor of FIG. 1A;

FIG. 2A is an axially sectioned side view of a compressor in accordance with a second embodiment of the invention;

FIG. 2B is an axially sectioned isometric view of the compressor of FIG. 2A;

FIG. 3A is an axially sectioned side view of a compressor in accordance with a third embodiment of the invention;

FIG. 3B is an axially sectioned isometric view of the compressor of FIG. 3A;

FIG. 4A is an axially sectioned side view of a compressor in accordance with a fourth embodiment of the invention;

FIG. 4B is an axially sectioned isometric view of the compressor of FIG. 4A;

FIG. 5A is an isometric view, partly in section, of a compressor in accordance with a fifth embodiment of the invention; and FIG. 5B is an isometric view, partly in section, of a strut insert employed in the compressor of FIG. 5A.

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1A and 1B illustrate a compressor 100 in accordance with a first embodiment of the present invention. The compressor comprises a compressor wheel 110 and a compressor housing 120 surrounding the compressor wheel and defining an inlet 122 for leading fluid along a main flow path into the compressor wheel 110. The fluid passes through the compressor wheel and is compressed thereby, and is discharged radially outwardly from the wheel 110, then passes through a diffuser 124 into a volute 126. The compressor housing 120 has a wall 128 surrounding the main flow path and defining a port slot 130 located adjacent the compressor wheel 110. The wall 128 further defines first and second bulbs 132 and 134, comprising bulb-shaped, generally annular hollow spaces in the wall. The first bulb 132 is located proximate the port slot 130 and is connected to the port slot, and the second bulb 134 is located proximate the inlet 122 to the compressor, upstream of the first bulb 132. The compressor housing further defines a connection 136 between the first and second bulbs that allows flow from one to the other in either direction. The connection 136 can be, for example, an annular space extending axially from one bulb to the other, the annular space being partitioned by a plurality of circumferentially spaced struts 127 extending radially from a radially outer wall portion to a radially inner wall portion of the wall 128.

The compressor housing 120 additionally defines a first passage 138 into the second bulb 134. The first passage 138 faces generally radially inwardly into the main flow path and allows fluid to pass between the main flow path and the second bulb 134 in either direction.

The two bulbs 132, 134 may provide acoustic wave cancellation by virtue of acoustic waves being reflected multiple times in different directions from the curved inner surfaces of the bulbs. The series of reflections at different angles may cause phase mismatch and thus cancellation of amplitude. The second (upstream) bulb 134 may also help block acoustic waves from being propagated forward.

In the illustrated embodiment, the compressor housing 120 includes a first portion that defines one wall of the diffuser 124, the volute 126, and a downstream part of the tip shroud adjacent the blades tips of the compressor wheel, and a second portion that defines an upstream part of the tip shroud as well as the wall 128 having the bulbs 132, 134, the port slot 130 into the first bulb, and the first passage 138 into the second bulb. The second portion of the compressor housing is formed separately from the first portion and comprises a generally annular structure that is inserted into a receptacle defined by the first portion. However, it should be understood that alternatively the compressor housing could be formed from fewer (e.g., one) or more pieces, as appropriate in a particular case.

FIGS. 2A and 2B illustrate a second embodiment of a compressor 200 comprising a variation of the first embodiment. Similar to the first embodiment, the compressor 200 comprises a compressor wheel 210 and a compressor housing 220 surrounding the compressor wheel and defining an inlet 222 for leading fluid along a main flow path into the compressor wheel 210. The fluid passes through the compressor wheel and is compressed thereby, and is discharged radially outwardly from the wheel 210, then passes through a diffuser 224 into a volute 226. The compressor housing 220 has a wall 228 surrounding the main flow path and defining a port slot 230 located adjacent the compressor wheel 210. The wall 228 further defines first and second bulbs 232 and 234, comprising bulb-shaped, generally annular hollow spaces in the wall. The first bulb 232 is located proximate the port slot 230 and is connected to the port slot, and the second bulb 234 is located proximate the inlet 222 to the compressor, upstream of the first bulb 232. The compressor housing further defines a connection 236 (e.g., an annular space partitioned by struts 227) that allows flow from one bulb to the other in either direction.

The compressor housing 220 additionally defines a first passage 238 into the second bulb 234. The first passage 238 faces generally radially inwardly into the main flow path and allows fluid to pass between the main flow path and the second bulb 234 in either direction.

The two bulbs 232, 234 may provide acoustic wave cancellation by virtue of acoustic waves being reflected multiple times in different directions from the curved inner surfaces of the bulbs. The series of reflections at different angles may cause phase mismatch and thus cancellation of amplitude. The second (upstream) bulb 234 may also help block acoustic waves from being propagated forward.

In the second embodiment, the compressor housing 220 defines a second passage 240 that connects with the second bulb 234. Thus, with this arrangement, depending on the operating condition fluid can flow through the first and second passages 238, 240 in either direction (to or from the second bulb 234), and likewise fluid can flow through the port slot 230 (to or from the first bulb 232) in either direction. The second passage 240 is directed towards the incoming flow and thus in a choked-flow condition some flow can enter the second passage into the second bulb 234, and then through the connection 236 to the first bulb 232 and out the port slot 230 into the compressor wheel, in order to increase the choke flow rate. There could be a small portion of the total flow going into the first passage 238 at the choked-flow operating condition.

Additionally, in a preferred embodiment each of the first and second passages 238, 240 into the second bulb 234 includes a row of vanes designated the first vanes 242 and second vanes 244, respectively. The second vanes 244 in the second passage 240 act like axial-flow inlet guide vanes, guiding the fluid to flow towards the compressor wheel 210 so as to increase the choke flow. The first vanes 242 in the first passage 238 are radial vanes for guiding recirculated flow (which flows through the compressor port slot 230 to the first bulb 232 and then through the connection 236 to the second bulb 234) through the first passage 238 back into the compressor inlet 222. The vane angle can be positive or negative. The first vanes 242 can be used to reduce the surge flow and to change the angle of incidence at the wheel inducer. The aim is to vary (increase or reduce) the pressure ratio in a surge operating regime.

The compressor housing 220 as illustrated is similar to the compressor housing 120 in that it comprises two separate portions. A first portion defines wall of the diffuser 224, the volute 226, and a downstream part of the tip shroud adjacent the blades tips of the compressor wheel, and a second portion that defines the inlet 222, an upstream part of the tip shroud, and the wall 228 having the bulbs 232, 234, the port slot 230 into the first bulb, the first passage 238 and second passage 240 into the second bulb, and the vanes 242, 244. The second portion comprises a generally annular structure that is inserted into a receptacle defined by the first portion. However, it should be understood that alternatively the compressor housing could be formed from fewer (e.g., one) or more pieces, depending on the needs of a particular application.

FIGS. 3A and 3B depict a compressor 300 in accordance with a third embodiment. Similar to the above-described embodiments, the compressor 300 comprises a compressor wheel 310 and a compressor housing 320 surrounding the compressor wheel and defining an inlet 322 for leading fluid along a main flow path into the compressor wheel 310. The fluid passes through the compressor wheel and is compressed thereby, and is discharged radially outwardly from the wheel 310, then passes through a diffuser 324 into a volute 326. The compressor housing 320 has a wall 328 surrounding the main flow path and defining a port slot 330 located adjacent the compressor wheel 310. The wall 328 further defines first and second bulbs 332 and 334, comprising bulb-shaped, generally annular hollow spaces in the wall. The first bulb 332 is located proximate the port slot 330 and is connected to the port slot, and the second bulb 334 is located proximate the inlet 322 to the compressor, upstream of the first bulb 332. The compressor housing further defines a connection 336 (e.g., an annular space partitioned by struts) between the first and second bulbs that allows flow from one to the other in either direction.

The compressor housing 320 additionally defines a first passage 338 into the second bulb 334. The first passage 338 faces generally radially inwardly into the main flow path and allows fluid to pass between the main flow path and the second bulb 334 in either direction.

In the third embodiment, the wall 328 of the compressor housing further defines a plurality of elongate blind holes 350 radiating outwardly through an inner surface of at least one of the first and second bulbs, and preferably both of the bulbs. The blind holes 350 act as quarter-wavelength resonators. The blind holes are of different lengths and diameters from one another, although for a given length and diameter there can be multiple holes having that length and diameter. The lengths and diameters of the blind holes 350 are selected based on the quarter-wavelength resonator concept. Different lengths of holes target different frequency bands, thus providing acoustic absorption across a wide frequency range. The target frequency range is from 5-20 kHz. Additionally, the wall 328 can define a generally annular projection 352 at a radially outer side of the first passage 338, on the upstream side of the passage 338 (i.e., the side relatively farther from the compressor wheel). The projection 352 extends generally radially outwardly into the second bulb 334.

As illustrated, the compressor housing 320 comprises four separate portions. A first portion defines the volute 326. A second portion defines one wall of the diffuser 324 and half of the first bulb 332 together with its associated blind holes 350. A third portion defines the other half of the first bulb 332, the connection 336, and half of the second bulb 334. A fourth portion defines the other half of the second bulb 334 together with its blind holes 350, and the inlet 322. Thus, the wall 328 is formed collectively by the second, third, and fourth portions of the housing. The port slot 330 comprises an axial space between the second and third portions of the housing. The first passage 338 into the second bulb 334 comprises an axial space between the third and fourth portions of the housing. However, the compressor housing could be made of a fewer number of pieces, if desired.

FIGS. 4A and 4B depict a compressor 400 in accordance with a fourth embodiment. Similar to the above-described embodiments, the compressor 400 comprises a compressor wheel 410 and a compressor housing 420 surrounding the compressor wheel and defining an inlet 422 for leading fluid along a main flow path into the compressor wheel 410. The fluid passes through the compressor wheel and is compressed thereby, and is discharged radially outwardly from the wheel 410, then passes through a diffuser 424 into a volute 426. The compressor housing 420 has a wall 428 surrounding the main flow path and defining a port slot 430 located adjacent the compressor wheel 410. The wall 428 further defines first and second bulbs 432 and 434, comprising bulb-shaped, generally annular hollow spaces in the wall. The first bulb 432 is located proximate the port slot 430 and is connected to the port slot, and the second bulb 434 is located proximate the inlet 422 to the compressor, upstream of the first bulb 432. The compressor housing further defines a connection 436 between the first and second bulbs that allows flow from one to the other in either direction.

The compressor housing 420 additionally defines a first passage 438 into the second bulb 434. The first passage 438 faces generally radially inwardly into the main flow path and allows fluid to pass between the main flow path and the second bulb 434 in either direction.

In the fourth embodiment, the connection 436 between the bulbs is a single-chamber muffler (expander). The muffler has a main chamber C comprising a generally annular hollow space having an axial length L and a radial height T. There is a first inlet/outlet connecting the first bulb 432 to the main chamber C, and a second inlet/outlet connecting the second bulb 434 to the main chamber C. The first and second inlets/outlets to the main chamber C are defined by generally annular openings in first and second ring-shaped members 454 and 456 each of which protrudes into the main chamber C. The generally annular openings have a radial height t. The distance of protrusion L1 of the first ring-shaped member 454 into the main chamber C and the distance of protrusion L2 of the second ring-shaped member 456 into the main chamber C are selected based on the frequencies to be attenuated. The ratios L1/L and L2/L and the area ratio dependent on t and T define the transmission loss and frequency range over which attenuation is provided. For a wider frequency range, L1/L can be 0.5 and L2/L can be 0.25.

As illustrated, the compressor housing 420 comprises five separate portions. A first portion defines the volute 426. A second portion defines one wall of the diffuser 424 and the first bulb 432. A third portion defines the first ring-shaped member 454. A fourth portion defines the second ring-shaped member 456. The main chamber C is defined between the third and fourth portions. A fifth portion defines the second bulb 434 as well as the inlet 422. Thus, the wall 428 is formed collectively by the second, third, fourth, and fifth portions of the housing. The port slot 430 comprises an axial space between the second and third portions of the housing. The first passage 438 into the second bulb 434 comprises an axial space between the fourth and fifth portions of the housing. However, the compressor housing could be made up of fewer pieces, if desired.

FIGS. 5A and 5B illustrate a compressor 500 in accordance with a fifth embodiment. The compressor 500 comprises a compressor wheel 510 having full (non-splitter) blades 512 that are N in number, and a compressor housing 520 surrounding the compressor wheel and defining an inlet 522 for leading fluid along a main flow path into the compressor wheel and through the compressor wheel to be compressed thereby. The compressor housing further defines a diffuser 524 and a volute 526. The compressor housing is formed by a first housing portion 520*a* defining the diffuser 524 and volute 526 as well as a generally tubular part that extends forwardly from the volute, and a generally ring-shaped second housing portion 520*b* defining the inlet 522 as well as ported shroud features. The second housing portion 520*b*, which is also called a "strut insert" herein, is inserted into the receptacle defined by the generally tubular part of the first housing portion 520*a* and is secured therein in suitable fashion.

The strut insert 520*b* includes an outer ring-shaped member 521 that surrounds and is radially spaced from an inner ring-shaped member 523 such that a generally annular space 525 exists between a radially inward side of the outer ring-shaped member 521 and a radially outer side of the inner ring-shaped member 523. The second housing portion 520*b* is arranged such that an axial space exists between a downstream end of the second housing portion and an adjacent portion of the first housing portion 520*a* so as to form a port slot 530 that connects with a downstream end of the generally annular space 525. There is also an axial space between the upstream end of the inner ring-shaped member 523 and an adjacent part of the outer ring-shaped member 521, which axial space forms a passage 531 that connects the compressor inlet 522 with an upstream end of the annular space 525.

The annular space 525 forms a recirculation path or alternate flow path that fluid can pass through in either direction, depending on the particular operating condition of the compressor.

The outer ring-shaped member 521 is connected to the inner ring-shaped member 523 by a plurality of circumferentially spaced struts 527 extending between the radially inward side of the outer ring-shaped member 521 and the radially outer side of the inner ring-shaped member 523. The struts are from N to 3N+1 in number, where, as noted, N is the number of full blades 512 of the compressor wheel. Thus, for example, if the compressor wheel has 6 full blades and 6 splitter blades, then there are from 6 to 19 struts 527. The struts 527 can be oriented with any desired angle relative to axial, including zero degree (axial, no swirl) or negative or positive angles.

As illustrated, the struts 527 can extend over the port slot 530. At the port slot 530, the struts 527 can have an angle of about 25 to 65 degrees, and they guide the compressed air from the compressor wheel inducer into the annular space 525. At the passage 531, the struts 527 can turn the flow to a 0-degree (axial) direction or to some negative or positive angle relative to axial, as desired.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A compressor, comprising:

a compressor wheel; and a compressor housing surrounding the compressor wheel and defining an inlet for leading fluid along a main flow path into the compressor wheel and through the compressor wheel to be compressed thereby, the compressor housing having a wall surrounding the main flow path and defining a port slot located adjacent the compressor wheel, the wall further defining first and second bulbs comprising bulb-shaped, generally annular hollow spaces, the first bulb being located proximate the port slot and being connected to the port slot, the second bulb being located proximate the inlet to the compressor, upstream of the first bulb, the compressor housing further defining a connection between the first and second bulbs that allows flow from one to the other in either direction;

the compressor housing additionally defining a first passage into the second bulb, the first passage facing generally radially inwardly into the main flow path and allowing fluid to pass between the main flow path and the second bulb in either direction, and a second passage into the second bulb, the second passage facing generally axially towards the flow coming into the inlet such that in a choked-flow condition some fluid can enter the second passage into the second bulb, and then through the connection to the first bulb and out the port slot into the main flow path.

2. The compressor of claim 1, further comprising a row of first vanes located in the first passage into the second bulb, the first vanes serving as radial vanes for guiding recirculated flow through the first passage back into the inlet to the compressor.

3. The compressor of claim 2, further comprising a row of second vanes located in the second passage for the second bulb, the second vanes serving as axial-flow inlet guide vanes for the fluid passing through the second passage.

4. A compressor, comprising:

a compressor wheel; and a compressor housing surrounding the compressor wheel and defining an inlet for leading fluid along a main flow path into the compressor wheel and through the compressor wheel to be compressed thereby, the compressor housing having a wall surrounding the main flow path and defining a port slot located adjacent the compressor wheel, the wall further defining first and second bulbs comprising bulb-shaped, generally annular hollow spaces, the first bulb being located proximate the port slot and being connected to the port slot, the second bulb being located proximate the inlet to the compressor, upstream of the first bulb, the compressor housing further defining a connection between the first and second bulbs that allows flow from one to the other in either direction;

the compressor housing additionally defining at least a first passage into the second bulb, the first passage facing generally radially inwardly into the main flow path and allowing fluid to pass between the main flow path and the second bulb in either direction, wherein the wall of the compressor housing further defines a plurality of elongate blind holes radiating outwardly through an inner surface of at least one of the first and second bulbs, the blind holes acting as quarter-wavelength resonators.

5. The compressor of claim 4, wherein at least some of the blind holes are of different lengths and diameters from one another.

6. The compressor of claim 5, wherein each of the first and second bulbs includes the blind holes.

7. The compressor of claim 4, wherein the wall defines a generally annular projection at a radially outer side of the first passage, the generally annular projection extending generally radially outwardly into the second bulb.

8. A compressor, comprising:

a compressor wheel; and a compressor housing surrounding the compressor wheel and defining an inlet for leading fluid along a main flow path into the compressor wheel and through the compressor wheel to be compressed thereby, the compressor housing having a wall surrounding the main flow path and defining a port slot located adjacent the compressor wheel, the wall further defining first and second bulbs comprising bulb-shaped, generally annular hollow spaces, the first bulb being located proximate the port slot and being connected to the port slot, the second bulb being located proximate the inlet to the compressor, upstream of the first bulb, the compressor housing further defining a connection between the first and second bulbs that allows flow from one to the other in either direction;

the compressor housing additionally defining at least a first passage into the second bulb, the first passage facing generally radially inwardly into the main flow path and allowing fluid to pass between the main flow path and the second bulb in either direction, and wherein the connection between the first and second bulbs comprises a muffler, wherein the muffler has a main chamber comprising a generally annular hollow space having an axial length L and a radial height T, the muffler further comprising a first inlet/outlet connecting the first bulb to the main chamber and a second inlet/outlet connecting the second bulb to the main chamber, the first and second inlets/outlets to the main chamber being respectively defined by first and second ring-shaped members each of which comprises two ring-shaped portions spaced radially apart from each other so as to define a generally annular passage therebetween, the generally annular passages of the first and second ring-shaped members defining said first inlet/outlet and said second inlet/outlet, wherein the ring-shaped portions of each of the first and second ring-shaped members protrude axially into the main chamber.

9. The compressor of claim 8, wherein a distance of protrusion L1 of the first ring-shaped member into the main chamber and a distance of protrusion L2 of the second ring-shaped member into the main chamber are selected based on the frequencies to be attenuated.

10. A compressor, comprising:

a compressor wheel having full blades that are N in number; and a compressor housing surrounding the compressor wheel and defining an inlet for leading fluid along a main flow path into the compressor wheel and through the compressor wheel to be compressed thereby, the compressor housing including a first housing portion that defines a volute and a second housing portion that defines an outer ring-shaped member that surrounds and is radially spaced from an inner ring-shaped member such that a generally annular space exists between a radially inward side of the outer ring-shaped member and a radially outer side of the inner ring-shaped member, the second housing portion being arranged such that an axial space exists between a downstream end of the second housing portion and an adjacent portion of the first housing portion so as to form a port slot that connects with a downstream end of the generally annular space, an axial space existing between an upstream end of the inner ring-shaped member and an adjacent part of the outer ring-shaped member, which axial space forms a passage that connects the inlet of the compressor with an upstream end of the annular space, the annular space forming a recirculation path or alternate flow path that fluid can pass through in either direction, depending on the particular operating condition of the compressor, the outer ring-shaped member being connected to the inner ring-shaped member by a plurality of circumferentially spaced struts extending between the radially outer side of the outer ring-shaped member and the radially inward side of the inner ring-shaped member, wherein the struts are from N to 3N+1 in number, and wherein the struts extend over the port slot and at the port slot the struts have a radial angle of about 25 to 65 degrees, and the struts guide the compressed air from the compressor wheel into the annular space.

11. The compressor of claim 10, wherein upstream ends of the struts extend into the passage that connects with the inlet.

* * * * *